US007117654B2

(12) United States Patent
Danks

(10) Patent No.: US 7,117,654 B2
(45) Date of Patent: Oct. 10, 2006

(54) PACKAGING PROCESS EMPLOYING A CLOSURE ORIFICE SEAL VENT

(75) Inventor: Christopher A. Danks, Waukesha, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 59 days.

(21) Appl. No.: 11/025,704

(22) Filed: Dec. 29, 2004

(65) Prior Publication Data

US 2006/0138163 A1 Jun. 29, 2006

(51) Int. Cl.
*B65B 7/28* (2006.01)
*B65B 63/08* (2006.01)
*B65D 51/16* (2006.01)

(52) U.S. Cl. ..... 53/420; 53/440; 53/471; 53/133.2; 53/127; 53/281; 215/307; 220/367.1; 222/556

(58) Field of Classification Search ..... 53/410, 53/412, 420, 471, 490, 133.2, 139.2, 127, 53/281, 317, 320, 331.5; 215/307, 235, 237; 220/837, 847, 366.1, 367.1; 222/212, 556; B65B 63/08
See application file for complete search history.

(56) References Cited

U.S. PATENT DOCUMENTS

| | | | | | |
|---|---|---|---|---|---|
| 669,702 | A * | 3/1901 | Nash | 426/401 |
| 2,178,140 | A * | 10/1939 | Fetzer | 215/307 |
| 4,699,301 | A * | 10/1987 | Blake | 222/546 |
| 5,143,236 | A * | 9/1992 | Gueret | 215/311 |
| 5,409,144 | A * | 4/1995 | Brown | 222/185.1 |
| 5,934,512 | A * | 8/1999 | Lampe et al. | 222/108 |
| 5,938,056 | A * | 8/1999 | Ma | 215/237 |
| 5,984,123 | A * | 11/1999 | Mogami et al. | 215/235 |
| 6,089,419 | A * | 7/2000 | Gross | 222/494 |
| 6,129,228 | A * | 10/2000 | Adams et al. | 215/45 |
| 6,202,870 | B1 * | 3/2001 | Pearce | 215/307 |
| 6,202,872 | B1 * | 3/2001 | Smeyak et al. | 215/343 |
| 6,321,923 | B1 * | 11/2001 | Wood | 215/235 |
| 6,375,028 | B1 * | 4/2002 | Smith | 220/258.1 |
| 6,401,986 | B1 * | 6/2002 | Randall | 222/212 |
| 2003/0110736 | A1 * | 6/2003 | Boyd | 53/440 |

FOREIGN PATENT DOCUMENTS

JP 10072056 A * 3/1998

OTHER PUBLICATIONS

Prior Art Drawing Sheet 1/4.
Prior Art Drawing Sheet 2/4.
Prior Art Drawing Sheet 3/4.

(Continued)

*Primary Examiner*—Stephen F. Gerrity
(74) *Attorney, Agent, or Firm*—Wood, Phillips, Katz, Clark & Mortimer

(57) ABSTRACT

A process is provided for minimizing moisture accumulation in a product package that is sprayed with a cool water shower. The product is placed in a container, and a closure is installed on a container. The product is heated before it is placed in the container or during its placement in the container, or after it is placed in the container, or while the closure is being installed on the container, or after the closure has been installed on the container. The internal atmosphere within the closed closure is allowed to expand from the heat and to vent through a vent channel. The package is cooled with a cooling water shower, and the vent channel minimizes the transient pressure differential so as to minimize the amount of water infiltration into the closure.

5 Claims, 9 Drawing Sheets

OTHER PUBLICATIONS

Prior Art Drawing Sheet 4/4.
Prior Art Drawing A-1.
Prior Art Drawing A-2.
Prior Art Drawing A-3.
Prior Art Drawing B-1.
Prior Art Drawing B-2.
Prior Art Drawing B-3.
Prior Art Drawing B-4.

* cited by examiner

PACKAGING PROCESS EMPLOYING A CLOSURE ORIFICE SEAL VENT

CROSS-REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a packaging process employing a vented closure system for a container.

BACKGROUND OF THE INVENTION AND TECHNICAL PROBLEMS POSED BY THE PRIOR ART

The upper portion of a conventional package 30 is shown in FIG. 1, and the package includes a container 32 which has been filled with a fluent product (not visible). The container 32 has an upper opening 33 (FIGS. 2 and 5), and the top of the container 32 is covered or closed with a closure system or closure 36 (FIG. 1) which is mounted to the top of the container 32.

An optional "liner" seal member 38 (FIGS. 2 and 5) may be employed as part of the closure system. Typically, such an optional liner 38 is a membrane that includes at least one layer of thermoplastic material that can be heat-sealed to the top rim of the container 32 around the container opening 33. In FIG. 5, such a heat seal is schematically illustrated by the small triangles 40. If such an optional heat seal 38 is employed, the user of the package 30 (FIG. 1) must initially remove the closure 36 from the top of the container 32 and cut away or peal away the liner 38. Then the user can reinstall the closure 36 on the top of the container 32.

The illustrated form of the conventional closure 36 is mounted on the container 32 with a threaded engagement system. To this end, the container 32 typically includes a conventional thread 44 (FIGS. 2 and 5) for being threadingly engaged by the closure 36.

As shown in FIG. 4, the closure 36 includes a closure body or base 46 which has a peripheral skirt 48 depending downwardly from a deck 50. The center of the deck 50 merges into a upwardly projecting spout 52 which defines a dispensing orifice 54.

As can be seen in FIG. 5, the skirt 48 of the closure body 46 has an interior surface on which is formed a thread 58 for threadingly engaging the container thread 44. The closure body 46 could be mounted on the container 32 with other attachment systems, such as cooperating, releasable beads, or beads and grooves, so as to retain the closure body 46 and container 32 together in a sealing relationship. In other designs, the closure body 46, although separately manufactured from the container 32, could be subsequently permanently attached to the top of the container 32 by means of induction bonding, ultrasonic bonding, gluing, or the like, depending on the materials employed for the container and the closure body 46. In some applications, the closure body 46 may be molded as a unitary part, or extension, of the top of the container 32.

In the type of conventional closure 36 illustrated in FIGS. 2 and 5, the closure body 46 includes a pressure-actuatable, flexible, slit-type valve 60 which is held inside the spout 52 by means of an annular retainer ring 62 that is snap-fit into the spout 52. The valve 60 may be of the well-known type sold in the United States of America by Liquid Molding Systems, Inc., 2202 Ridgewood Dr., Midland, Mich. 48642, U.S.A.

The particular form of the valve 60 illustrated is molded as a unitary structure from material which is flexible, pliable, elastic, and resilient. This can include elastomers, such as a synthetic, thermosetting polymer, including silicone rubber, such as a silicone rubber sold by Dow Corning Corp. in the United States of America under the trade designation D.C. 99-595-HC. Another suitable silicone rubber material is sold in the United States of America under the designation Wacker 3003-40 by Wacker Silicone Company. Both of these materials have a hardness rating of 40 Shore A. The valve 60 could also be molded from other thermosetting materials or from other elastomeric materials, or from thermoplastic polymers or thermoplastic elastomers, including those based upon materials such as thermoplastic propylene, ethylene, urethane, and styrene, including their halogenated counterparts.

The design configuration of valve 60, and the operating characteristics thereof, are substantially similar to the configuration and operating characteristics of the valve designated by the reference number 3d in the U.S. Pat. No. 5,409,144. The description in that patent is incorporated herein by reference to the extent pertinent and to the extent not inconsistent herewith.

The valve 60 includes a recessed, central head which is flexible and which has an outwardly concave configuration (as viewed from the exterior of the valve 60 when the valve 60 is mounted in the spout 52). The head defines two, mutually perpendicular, intersecting slits of equal length extending through the head to define a normally self-sealing, closed orifice. The intersecting slits define four, generally sector-shaped, flaps or petals in the head. The flaps open outwardly from the intersection point of the slits in response to an increasing pressure differential of sufficient magnitude in the well-known manner described in the above-discussed U.S. Pat. No. 5,409,144.

The valve 60 has an interior side for facing generally into the spout 52 and an exterior side for facing generally outwardly from the spout 52. The interior side of the valve 60 is adapted to be contacted by the fluid product in the container 32, and the exterior side of the valve 60 is exposed to the ambient external atmosphere when the lid 70 is opened.

The valve 60 includes a thin skirt which extends axially and radially outwardly from the central, recessed valve head. The outer end portion of the skirt terminates in an enlarged, much thicker, peripheral flange which has a generally dovetail-shaped, transverse cross section and which is clamped by the retainer ring 62 to hold the valve 60 in the closure.

When the valve 60 is properly disposed in the spout 52, with the valve head in the closed condition, the valve head is recessed relative to the end of the spout 52 (FIG. 5). However, when the valve head is forced outwardly from its recessed position by a sufficiently large pressure differential across the valve, the valve 60 opens. More specifically, after the closure lid 70 (described in detail hereinafter) has been opened, and when the pressure on the interior side of the valve 60 exceeds the external ambient pressure by a predetermined amount, the valve head is forced outwardly from the recessed or retracted position to an extended, open position (not shown).

During the valve opening process, the valve head is initially displaced outwardly while still maintaining its generally concave, closed configuration. The initial outward displacement of the concave head is accommodated by the relatively, thin, flexible, skirt. The skirt moves from a recessed, rest position to a pressurized position wherein the skirt extends outwardly toward the open end of the spout 52. However, the valve 60 does not open (i.e., the slits do not open) until the valve head has moved substantially all the way to a fully extended position. Indeed, as the valve head moves outwardly, the valve head is subjected to radially inwardly directed compression forces which tend to further resist opening of the slits. Further, the valve head generally retains its outwardly concave configuration as it moves forward and even after the sleeve reaches the fully extended position. However, when the internal pressure becomes sufficiently great compared to the external pressure, then the slits in the extended valve head quickly open to dispense product.

As can be seen in FIG. 4, the closure 36 includes a lid 70 which, in a typical conventional arrangement, is hingedly connected to the closure body 46 with a snap-action type hinge 72. One form of such a snap-action type hinge 72 is described in the U.S. Pat. No. 6,321,923. Other types of hinges could be used. In some applications, the hinge could be omitted, and the lid need not be connected to the body at all.

As can be seen in FIG. 4, the lid includes a peripheral skirt 74 which depends from a top wall 76. Projecting form the inside of the top wall 76 is a sealing collar 78 which has a radially inwardly projecting, annular, sealing bead 80. The sealing bead 80 is an uninterrupted, convex structure which is adapted to engage the exterior of the spout 52, and the exterior of the spout 52 may be characterized as defining a first engaging surface 82 (FIG. 4). The lid sealing collar 78 may be characterized as an occlusion member for closing the spout 52 and having a second engaging surface of the lid sealing collar 78 for engaging the spout first engaging surface 82. In the illustrated embodiment, the second engaging surface is the annular sealing bead 80.

The lid 76 of the conventional closure 36 also includes a downwardly projecting member 86 (FIGS. 4 and 5). When the lid 76 is closed, the member 86 is spaced just above the central head of the valve 60. If the package is subjected to an over-pressure condition when the lid is closed (such as if the container 32 is impacted or squeezed after the liner 38 has been removed), then the upward, outward movement of the head of the valve 60 caused by such an internal over-pressure condition will be limited by engagement with the lid member 86 so as to prevent the valve 60 from opening inside the closed lid 70.

The above-described package 30 may be used for packaging a variety of products. However, it has been found that such a package 30 may be less desirable with some types of products that undergo certain kinds of processing. In particular, some products are packaged in a thermally hot condition. That is, prior to the closure 36 being installed on the open container 32, the open container 32 is filled by the product manufacturer with product that is thermally hot, and then subsequently, the liner 38 is installed on the container, and the closed closure 36 is mounted on the container 32. In other packaging processes for some types of food products, the product is not heated before it is introduced into the container; rather, after the closure is installed on the filled container, the entire package is moved to a pasteurizing station wherein the package is subjected to heat from an external source so as to raise the temperature of the product within the package to a sufficient magnitude and for a sufficient amount of time to effect pasteurization of the food product.

In any event, whether the product is hot-filled into a container that is subsequently closed with a closure, or cold-filled into a package that is subsequently closed with a closure and then heated as part of a pasteurization process, the heat can cause the interior atmosphere in the package to expand. Even where a sealing liner 38 and valve 60 are employed, as shown in FIG. 5, the internal atmosphere in the closure between the lid sealing collar 78 and the valve 60 can become heated so that the pressure increases and the internal atmosphere seeks to expand. It has been found that in a conventional, inexpensive, disposable, thermoplastic closure, a conventional sealing engagement between the closure lid and closure spout is not air-tight during such over-pressure conditions. Even an annular sealing bead, such as the sealing bead 80 (FIG. 5), does not provide air-tight sealing between the closure lid and closure body spout when there is a differential pressure across the sealing region as a result of a heat-induced, transient pressure increase in the closed region within the sealing collar 78. The pressure under the lid 70 on the exterior of the sealing collar 78 is substantially the same as the ambient atmospheric pressure around the exterior of the closure 36 owing to the significant gaps existing in the region of the hinge 72 at the hinge ends (designated in FIG. 3 by reference numbers 90). The heated, expanding internal atmosphere within the lid collar 78 leaks out between the lid annular seal 80 and spout exterior surface 82 (FIG. 5). The pressure around the lid collar 78 under the lid 70 remains substantially equal to the exterior ambient atmospheric pressure outside of the closure 36 owing to the significant openings at each edge 90 of the hinge 72 (FIG. 3).

The heated package (whether heated from initial hot filling of the product or subsequent pasteurization of a cold-filled product), typically is rapidly cooled in a subsequent step of the process. It is desirable to rapidly cool the package in order to facilitate subsequent processing operations, such as applying a label to each package and/or stacking the packages for further handling or shipping. If the package container 32 is made of a thermoplastic material, the heated container material loses much of its strength when it is hot, and the container wall can easily buckle or collapse during labeling processes or stacking processes. Thus, in typical high-speed, packaging process lines, the heated packages are quickly moved to and through a station which rapidly cools the packages prior to labeling and/or stacking.

The typical station used for cooling such packages incorporates a cooling tunnel wherein a cool water shower is sprayed onto the packages. The cool water shower reduces the temperature of the packages. However, as the temperature of a package decreases, the internal atmosphere within the closed spout cools, and the internal pressure begins to decrease. When a conventional package such as package 30 shown in FIG. 5 is cooled, there is a decrease in the temperature of the package interior, including in the temperature of the spout internal atmosphere in the region below the valve and in the region between the valve 60 and the closure lid sealing collar 78. This temperature decrease causes the pressure of the internal atmosphere within the closed spout 52 to decrease. This causes a partial vacuum (i.e., lower pressure) to be created inside of the closure lid sealing collar 78 relative to the external ambient atmosphere. However, the pressure differential between the higher pressure of the external ambient atmosphere and the lower pressure of the internal atmosphere draws some external ambient atmosphere past the sealing surfaces between the lid collar 78 and spout 52. Because the external ambient atmosphere in the cooling tunnel includes moisture in the form of water and water vapor, such water and/or water vapor can be drawn under the lid 70 and into the interior space inside the lid sealing collar 78. Further, some water may have been sprayed directly through the hinge open edges 90 and into the lid 70 and on the exterior of the spout 52 outside of the lid collar 78. Even when the package 30 has exited the cooling tunnel, water from the cool water shower can remain on and around the package closure exterior surfaces, especially at the closure hinge open edges 90 (FIG. 3). As the internal atmosphere within the lid collar 78 cools and contracts, the differential between the greater atmospheric pressure outside of the lid collar 78 and the lower pressure in the internal atmosphere inside of the lid collar 78 tends to draw in the moisture or water vapor past the annular seal bead 80 and into the internal volume within the lid sealing collar 78. Some of the moisture or water vapor being pulled in from the external ambient atmosphere may collect as water on the top surface of the deck 50 under the lid 70, and some is pulled all the way past the sealing collar 78. Some of the moisture or water vapor that is pulled past the sealing collar 78 could then eventually accumulate as liquid water in and around the spout opening 54, and also on the outwardly facing surface of the valve 60. If the package is of the type that does not have a valve 60, such infiltrating water and water vapor might reach the region directly above, or on, the liner 38. If no liner 38 is employed, then the water and water vapor could contact the product within the container 32.

The cooling spray water that has been pulled past the closure lid 70 (and that is deposited on the deck 50 and/or in other areas of the package inwardly of the lid sealing collar 78) presents an undesirable packaging condition. Cooling tunnel shower water is typically treated to inhibit growth of mold, bacteria, etc. However, the presence of water or water vapor on the deck 50 under the lid 70 and also inwardly of the lid spout seal region is undesirable from the standpoint of consumer perception when the consumer later opens the package by lifting the lid 70. Water under the closure lid in the dispensing orifice region may be regarded by the consumer as a problem with product quality or sanitary conditions. If a product manufacture had not properly treated the cooling spray water to inhibit the growth of mold, bacteria, etc., then the presence of water within the internal portion of the closure could lead to growth of mold, bacteria, etc.

The inventor of the present invention, and others, have investigated ways in which to minimize or eliminate the infiltration of cooling tunnel shower water onto the surface of the deck 50 under the lid 70 as well as into the interior of a closure beyond the closure lid seal. For a typical low-cost, disposable, dispensing closure molded from thermoplastic material, the inventors have been unable to design a readily manufactured closure that is easily openable by the consumer and that has an essentially 100% leak-tight seal to prevent cooling water ingress in response to a partial vacuum within the package during package cool-down.

BRIEF SUMMARY OF THE INVENTION

Contrary to conventional wisdom regarding improved sealing techniques, the inventor of the present invention has discovered that cooling water infiltration can be significantly minimized, if not eliminated, by breaching a conventional lid/spout seal with a venting system incorporated to function in specific ways during the packaging process. Surprisingly, venting the closure system during the packaging process has been found, contrary to initial expectations, to greatly minimize, if not eliminate, cooling water infiltration.

The process of the present invention is especially suitable for use with food products that are packaged in containers by hot-filling and/or that are heat-pasteurized in the package.

The invention process can accommodate containers which have a variety of shapes and which are constructed from a variety of materials.

The invention process can accommodate efficient, high-quality, high-speed, large volume manufacturing techniques with a reduced product reject rate.

The present invention provides a process for minimizing moisture accumulation in a product package. The process comprises the steps of:

(A) placing a quantity of the product in a container that has an opening;

(B) installing a dispensing closure on the container over the opening to form a package wherein the closure includes (1) a body having a spout that (a) defines a dispensing orifice, and (b) has an exterior and an interior, (2) a closed lid having an occlusion member for closing the spout, (3) a first engaging surface on the exterior or interior of the spout, (4) a second engaging surface on the occlusion member for engaging the spout first engaging surface, and (5) a vent channel defined through either or both of the first and second engaging surfaces;

(C) heating the product;

(D) allowing some of the internal atmosphere within the closed spout to expand from the heat and to vent through the vent channel to the external ambient atmosphere;

(E) cooling the package with a cooling water shower; and (F) permitting the external ambient atmosphere to enter the closed spout through the vent channel to the internal atmosphere within the closed spout as the package cools and the pressure of the internal atmosphere within the closed spout starts to decrease whereby the entering external ambient atmosphere minimizes the transient pressure differential between the internal atmosphere within the closed spout and the external ambient atmosphere so that the amount of water and/or water vapor entering past the closed lid and entering the closed spout past the first and second engaging surfaces and/or through the vent channel is minimized and whereby, after equalization between the pressure of the internal atmosphere and the pressure of the external ambient atmosphere, water vapor in the internal atmosphere within the closed spout can flow out of the closed spout through the vent channel in response to a water vapor gradient established when the external ambient atmosphere humidity is less than the internal atmosphere humidity.

Various other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENT

This specification and the accompanying drawings disclose only one specific form of the process of the invention. The invention is not intended to be limited to the described embodiment, however. The scope of the invention is pointed out in the appended claims.

The process of this invention is suitable for use with a variety of conventional or special containers having various designs, the details of which, although not illustrated or described, would be apparent to those having skill in the art and an understanding of such containers. Therefore, the particular container illustrated and described herein is not intended to limit the broadest aspects of the present invention.

Figure 9:
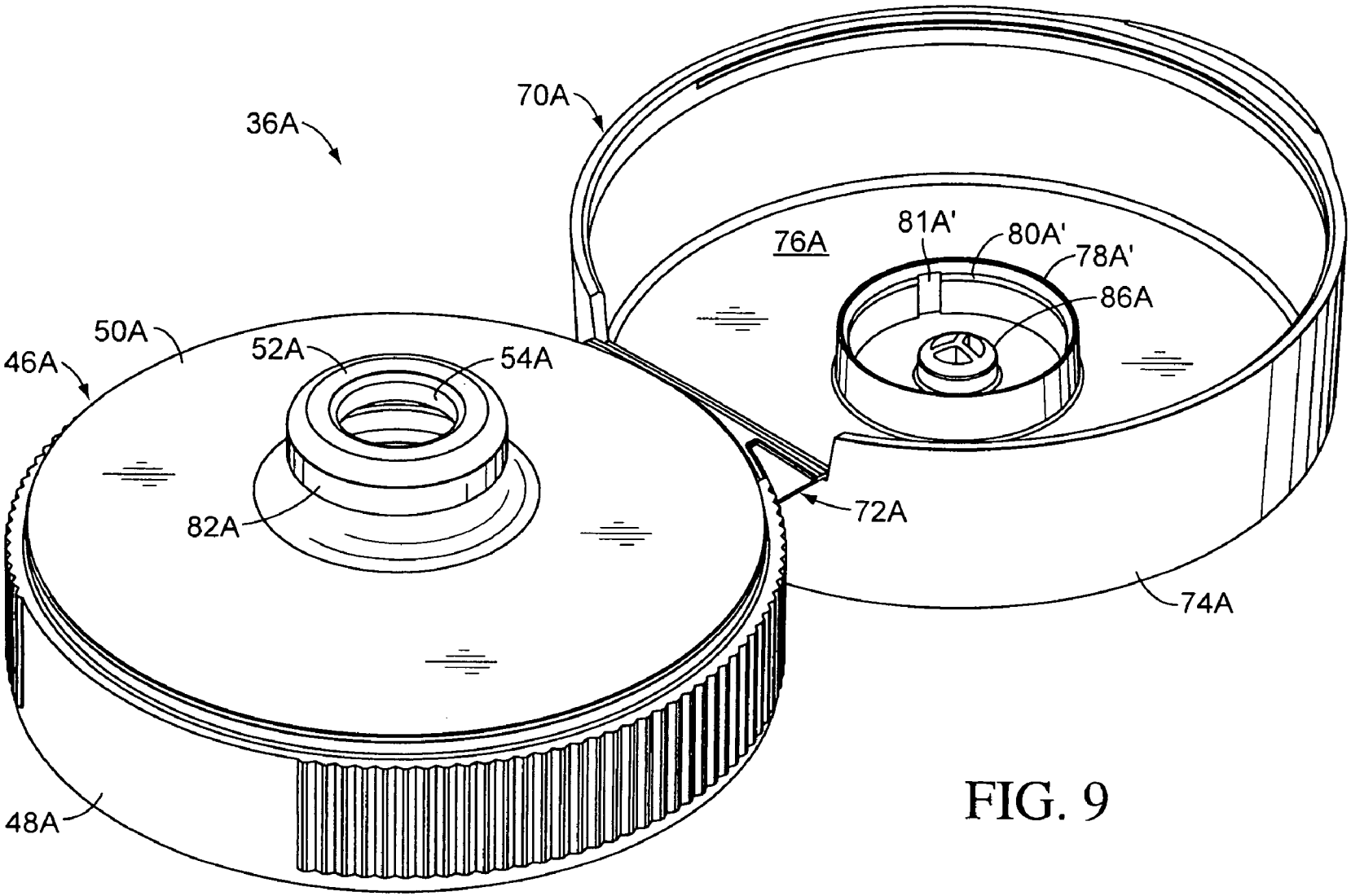
FIG. 9 is a view similar to FIG. 4, but FIG. 9 shows the modified closure illustrated in FIGS. 6–8.

According to the process of the present invention, a product can be provided and processed in a package which can employ a closure with a vent system which will function surprisingly to minimize the accumulation of moisture inside the package when the package is processed through a cool water shower, as in a cooling tunnel, which is used to cool the package. FIG. 9 illustrates a closure 36A which is similar to the closure 36 illustrated in FIGS. 1, 2, 3, 4, and 5. The closure 36A includes a closure body 46A having a skirt 48A and a deck 50A with an upwardly projecting spout 52A that defines a dispensing opening or orifice 54A. The spout 52A has a surface 82A (FIB. 6) which functions as a sealable surface, or sealing surface, or first engaging surface as described hereinafter. The terms "sealable surface," "sealing surface," and "engaging surface" are intended to have the same meaning are used interchangeably herein. As used in this specification and in the claims, the term "spout" includes any sealable structure that defines the dispensing orifice, and such a structure need not necessarily project upwardly from the deck 50A or other part of the closure.

The closure body 46A includes a flexible, pressure-actuated, slit-type valve 60A which is retained inside the closure body spout 52A with an annular retainer ring 62A which is snap-fit into engagement with the interior surface of the spout 52A. The valve 60 is a "pressure-openable" valve which opens when a sufficient pressure differential is applied across the valve (e.g., as by increasing the pressure on one side and/or decreasing the pressure on the other side).

The closure body 46A is connected with a hinge 72A to a lid 70A having a skirt 74A and a top wall 76A. Projecting from the inside of the lid top wall 76A is a member 86A.

As so far described, the closure 36A may be identical to the closure 36 described above with reference to FIGS. 1–5. The elements of the closure 36A that are identical with the closure 36 are designated with the same reference numbers followed by a suffix in the form of an upper case "A." The elements of the closure 36A that are identical with the elements of the closure 36 have the same structure, and function in the same way, as the corresponding elements of the closure 36 described above with reference to FIGS. 1–5.

Figure 1:
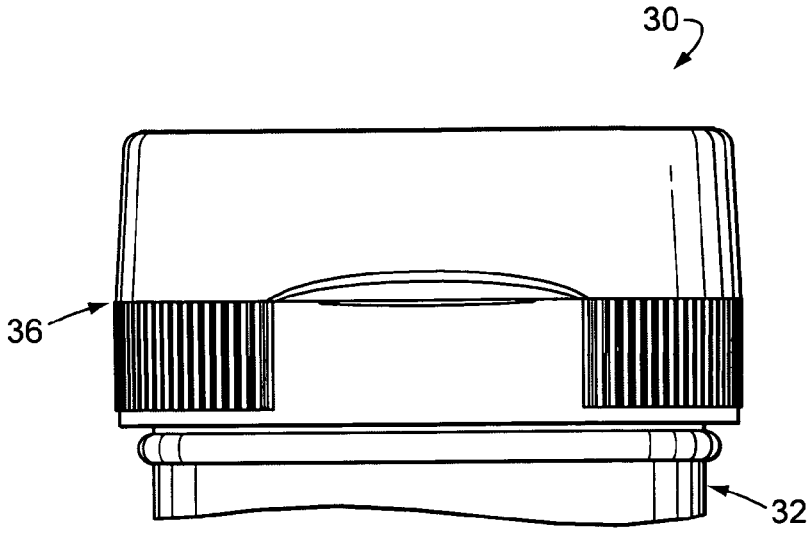
FIG. 1 (PRIOR ART)
FIG. 1 is a fragmentary, side elevational view of the upper portion of a package that can be assembled from conventional components and filled in a conventional manner with a product.
Figure 3:
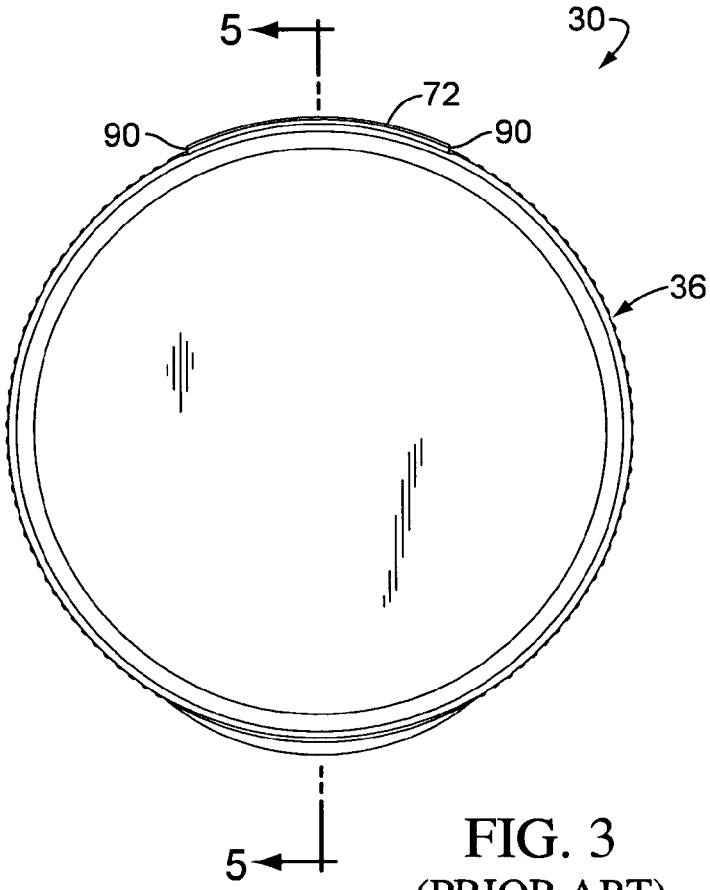
FIG. 3 (PRIOR ART)
FIG. 3 is a top plan view of the package shown in FIG. 1.
Figure 2:
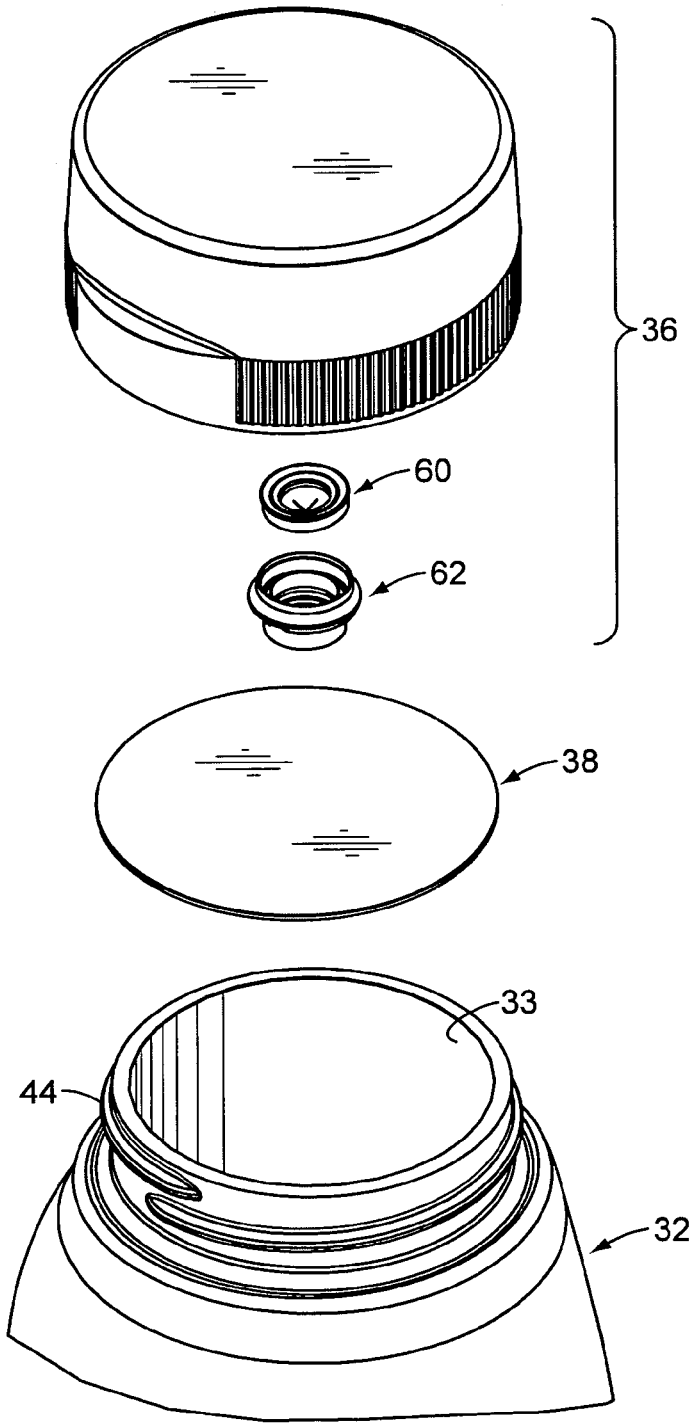
FIG. 2 (PRIOR ART)
FIG. 2 is a fragmentary, exploded, isometric view of the package shown FIG. 1.
Figure 4:
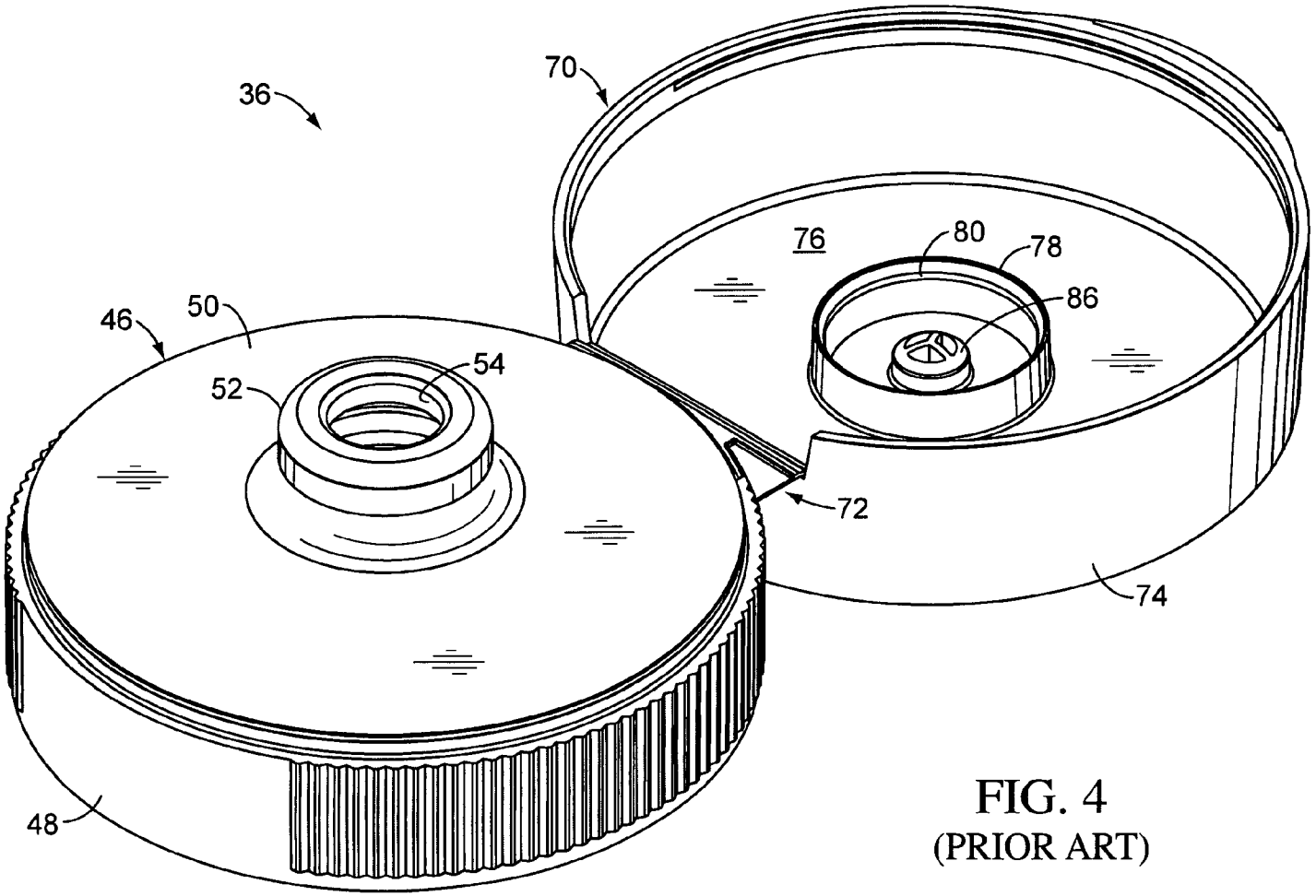
FIG. 4 (PRIOR ART)
FIG. 4 is an isometric view of the closure of the package shown in FIG. 1, and the closure is shown prior to assembly on the container in the package shown in FIG. 1, and the closure shown in an opened, substantially as-molded condition.
Figure 5:
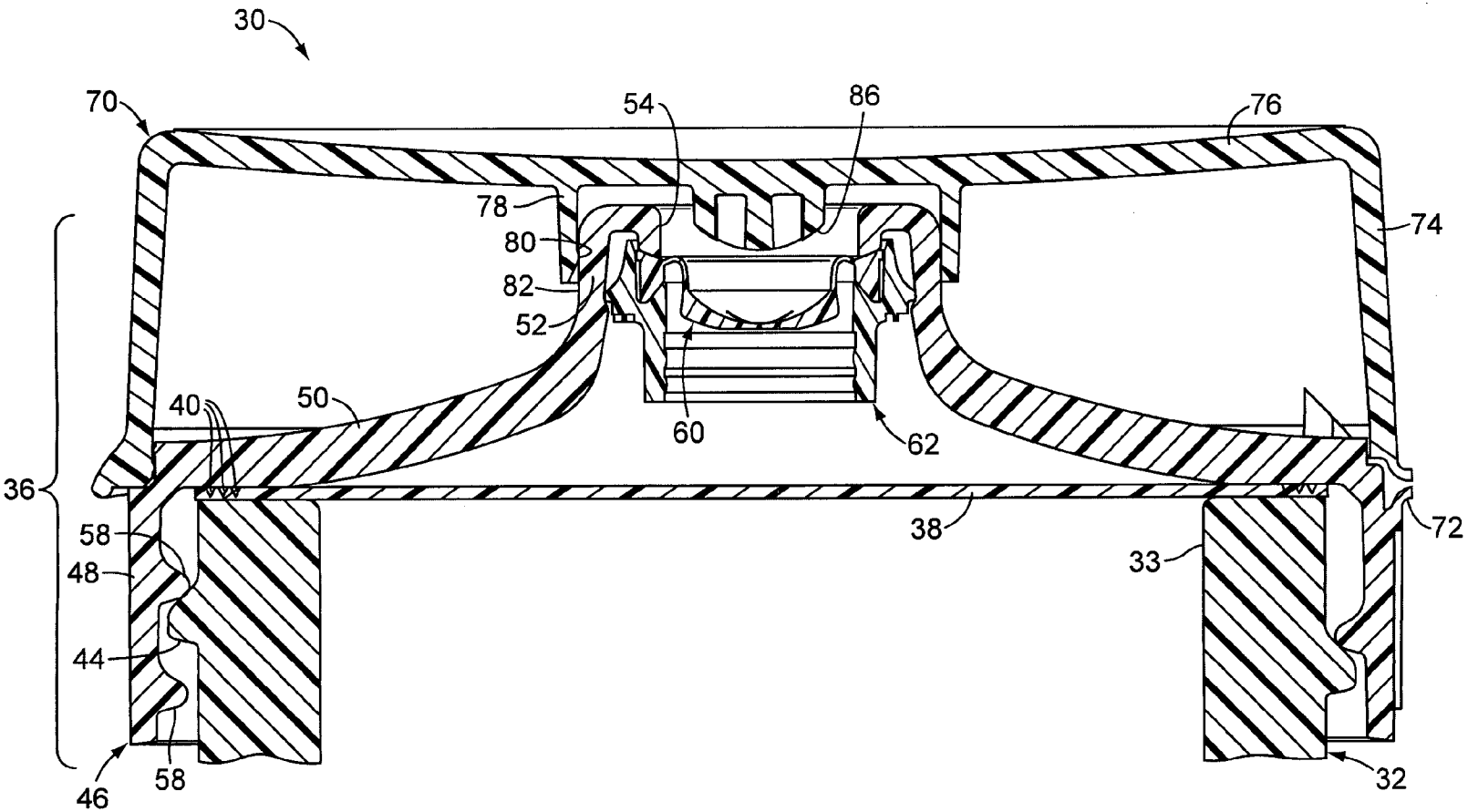
FIG. 5 (PRIOR ART)
FIG. 5 is an enlarged, cross-sectional view taken generally along the plane 5—5 in FIG. 3.
Figure 6:
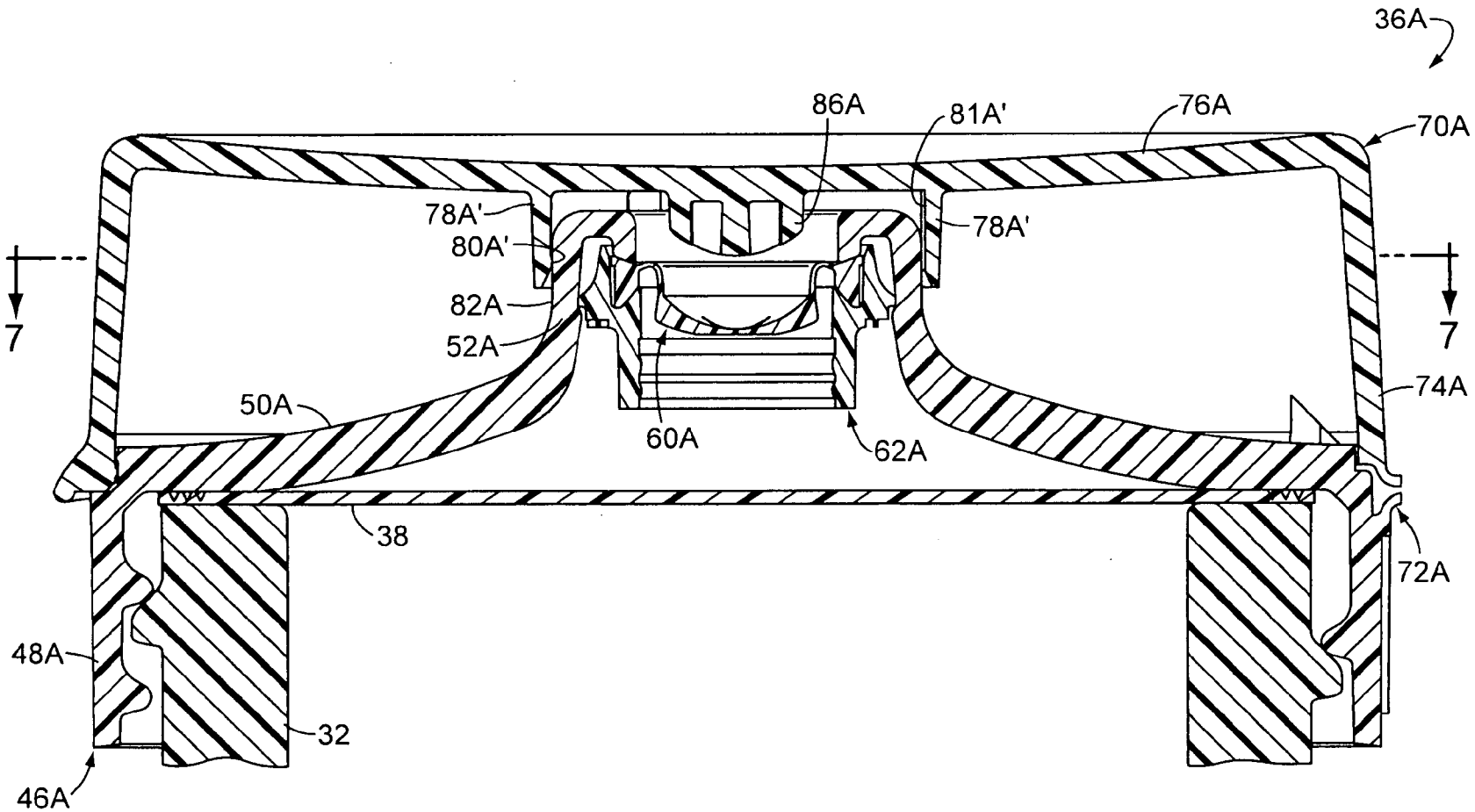
FIG. 6 is a view similar to FIG. 5, but FIG. 6 shows a modified closure structure for use in a package processed according to the process of the present invention.
Figure 7:
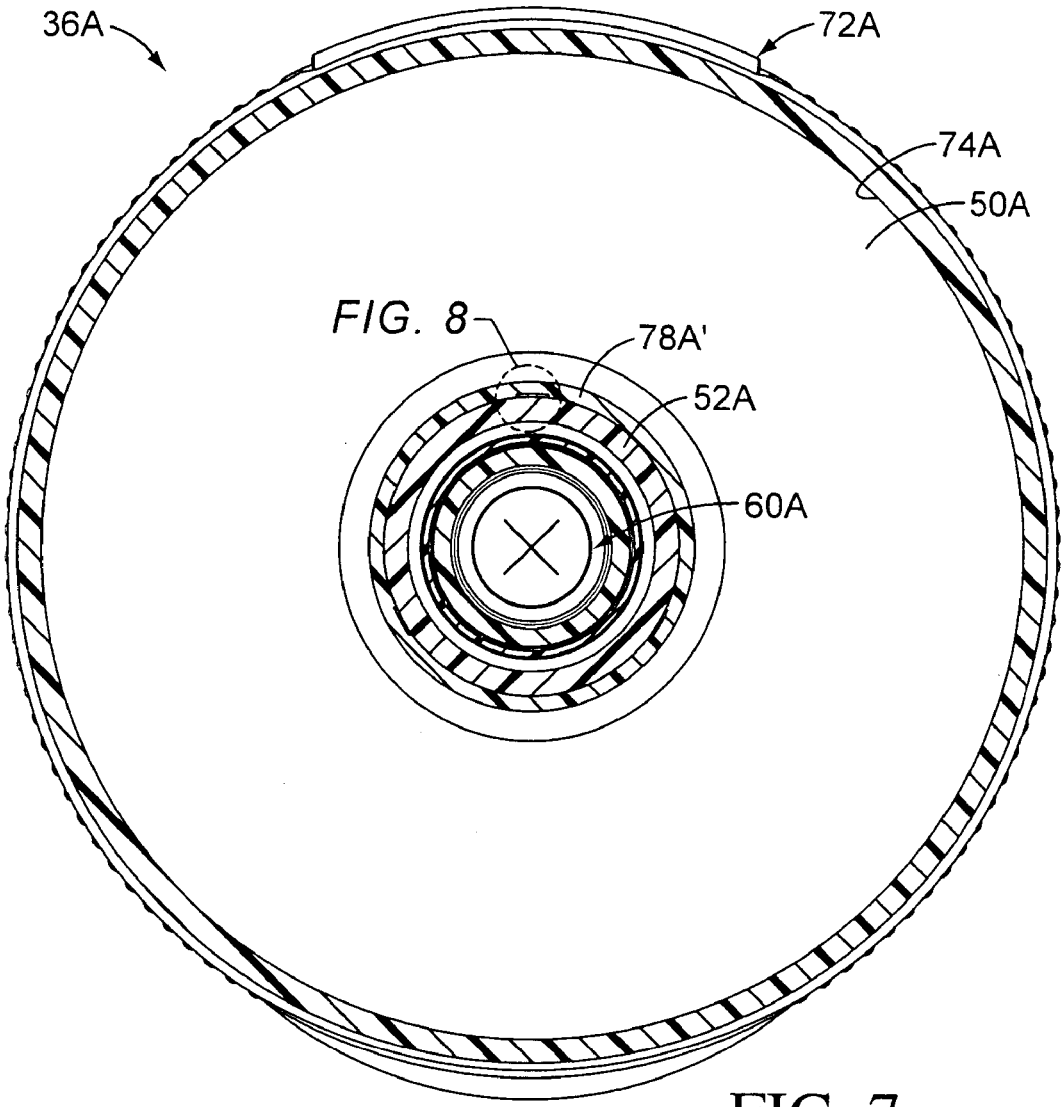
FIG. 7 is a reduced, cross-sectional view taken generally along the plane 7—7 in FIG. 6.
Figure 8:
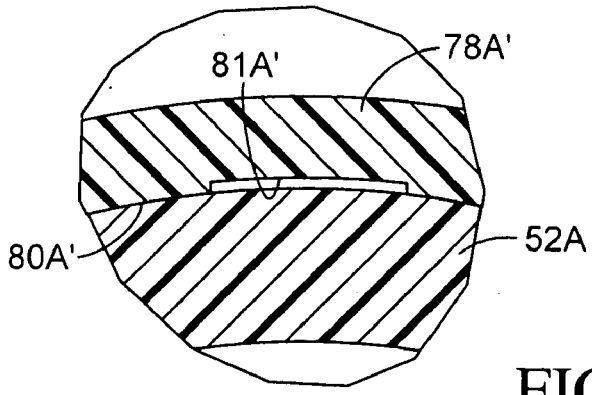
FIG. 8 is a greatly enlarged, fragmentary, cross-sectional view of the portion shown in FIG. 7 that is enclosed in circle designated "FIG. 8;"
Figure 10:
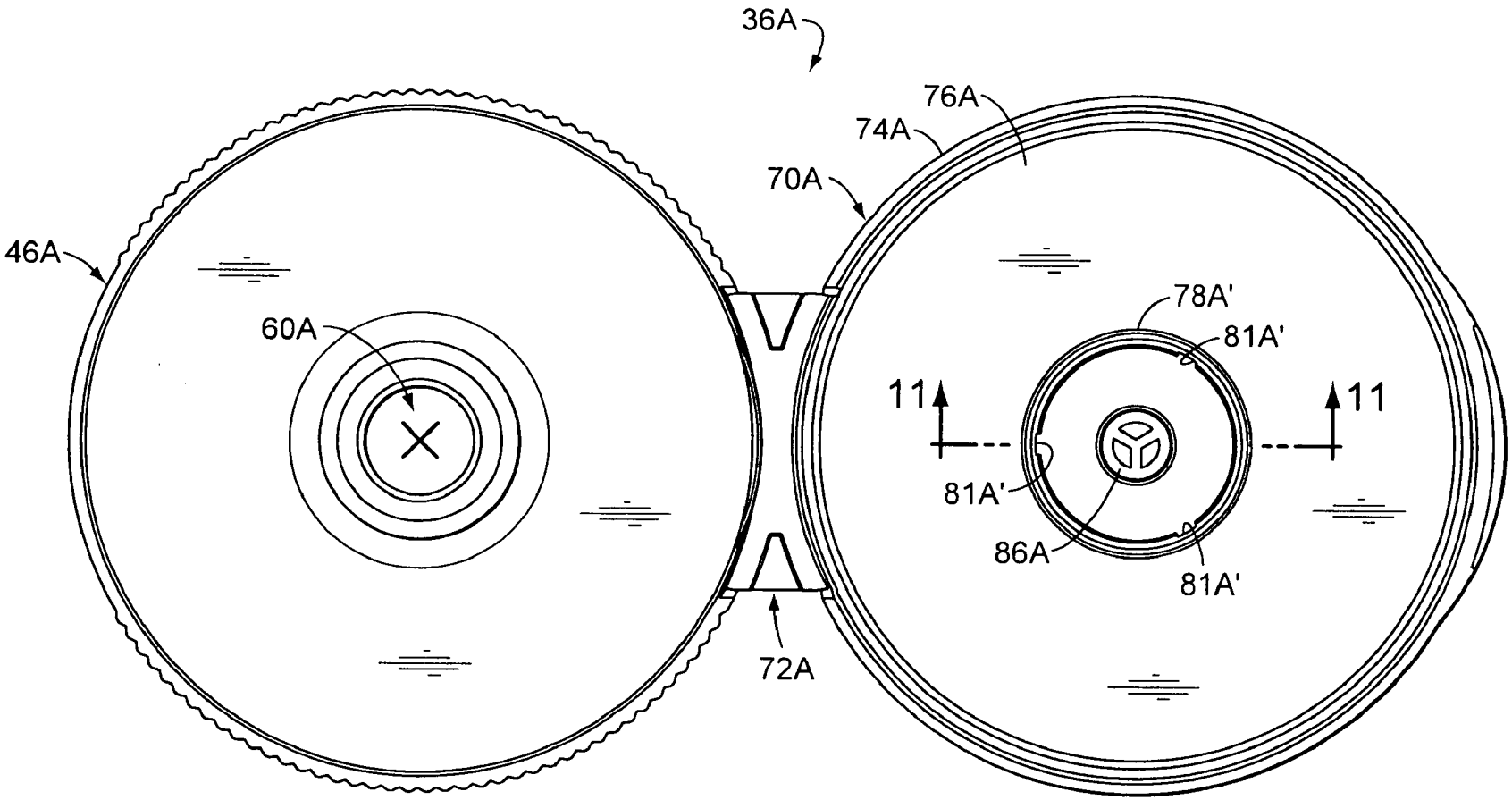
FIG. 10 is a top plan view of the closure shown in FIG. 9.
Figure 11:
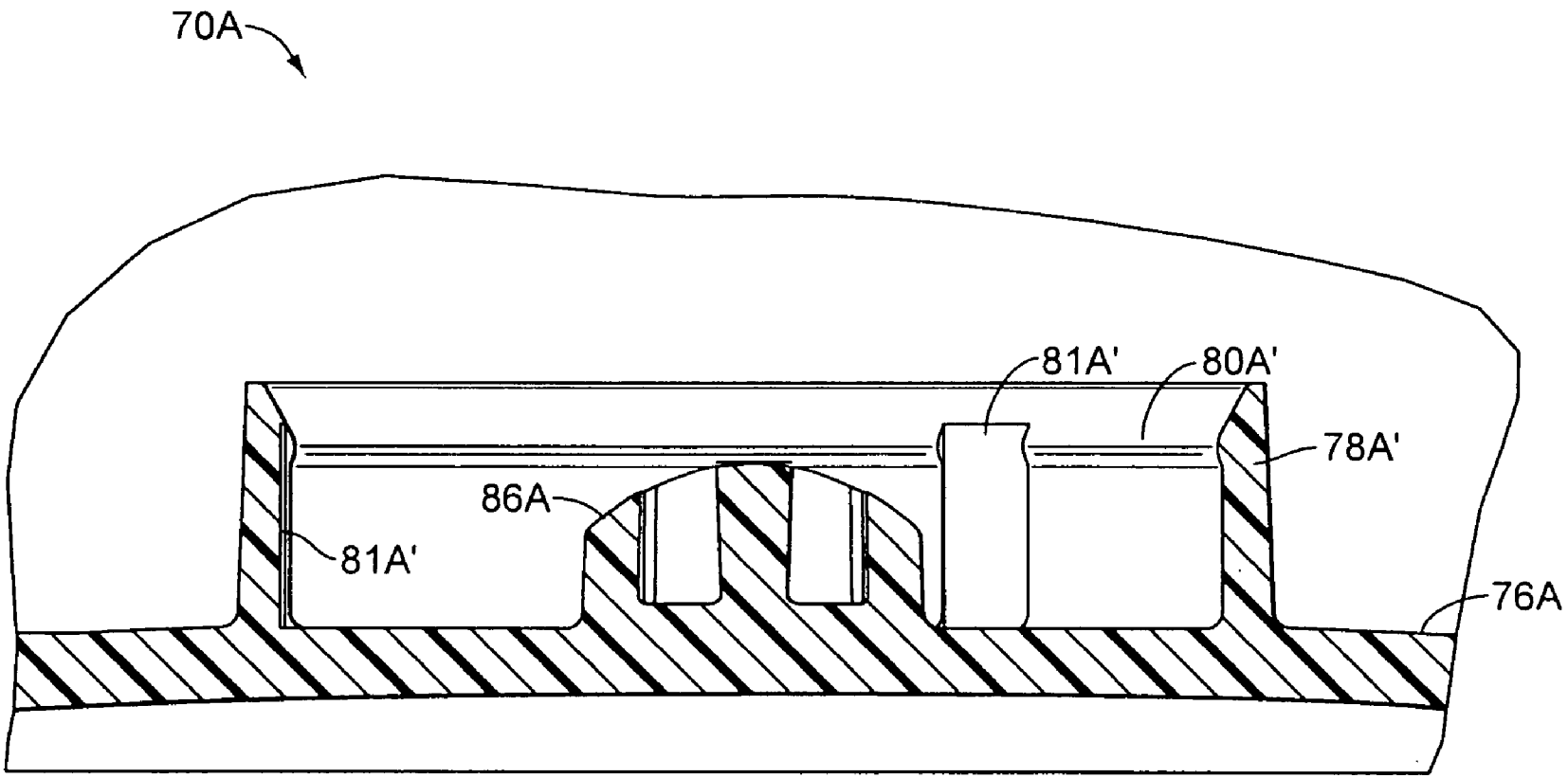
FIG. 11 is a greatly enlarged, fragmentary, cross-sectional view taken generally along the plane 11—11 in FIG. 10.

The difference between the closure 36A and the closure 36 resides in the lid sealing collar. The closure 36A has a lid sealing collar 78A' which includes a radially inwardly projecting bead 80A', but the bead 80A' does not extend in a complete circumferential ring or annular locus around the inside of the collar 78A'. Rather, the bead 80A' is interrupted in one or more locations by a vent channel 81A' as can be seen in FIG. 9. As can be seen in FIG. 10, in the preferred embodiment, there are three vent channels 81A' that are equally spaced around the interior circular locus defined by the sealing collar 78A'. As can be seen in FIG. 11, each vent channel 81A' is a relatively shallow channel in the interior surface or wall of the sealing collar 78A', and each channel 81A' extends through the bead 80A' so as to define three segments which each lies on a circular arc. FIGS. 6 and 7 illustrate the closure 36A installed on a container 32 which is sealed with a liner 38. The container 32 and liner 38 are identical with the container 32 and liner 38, respectively, described above with reference to the package 30 illustrated in FIGS. 1–5.

When the closure 36A is properly installed on the container 32 as illustrated in FIG. 6, the closure lid 70A is initially closed so that the lid collar 78A' is engaged around the spout 52A. The spout exterior surface 82A which is engaged by the lid collar 78A' may be characterized as a first engaging surface which is on the exterior of the spout 52A. The lid collar 78A' may be broadly characterized as an occlusion member, and the three-segment bead 80A' may be characterized as a second engaging surface on the lid collar or occlusion member 78A' for engaging the spout first engaging surface 82A. The vent channels 81A' may each be characterized as being defined through the second engaging surface or bead segments 80A'.

In other closure embodiments that may be used in the process of the present invention, the lid collar 78A' could be replaced by a smaller diameter member or plug for engaging the interior surface of the closure body spout opening 54A. In such an alternate embodiment, the outwardly facing, exterior cylindrical surface of the smaller diameter lid plug could be provided with bead segments interrupted with vent channels analogous to the vent channels 81A' described above.

In yet another embodiment, the bead segments 80A' could be eliminated from the lid, and instead, analogous bead segments could be provided on the spout—either on the exterior surface 82A or interior opening surface 54A of the spout—depending on whether either a collar or a plug is provided on the lid for engaging the spout exterior surface or spout interior surface, respectively.

In yet another embodiment, the seal bead segments could be eliminated altogether from the lid occlusion member (collar or plug) and the spout. In such an alternate structure, the adjacent, facing surfaces of the closure body spout and lid occlusion member would define a first engaging surface and a second engaging surface, respectively. One or both such engaging surfaces could be substantially cylindrical (or slightly tapered), but one or both of these surfaces would be provided with one or more vent channels analogous to the vent channels 81A' discussed above.

The process for employing the above-described vent channel structure will next be described in detail with respect to the particular embodiment illustrated in FIGS. 6–11. Initially, the closure 36A is provided as a separate component to be installed on the container 32. The closure 36A is provided to the product manufacturer or packager in a closed condition with the valve 60A installed and retained within the 52A spout by the retainer 62A. In some applications, the valve 60A may be omitted, and in such applications the interior configuration of the spout may be modified to provide a smooth interior surface along the underside of the deck 50A. In any event, the closed closure 36A is provided to the packager with the lid 70A in the closed configuration so that the closed closure can be subsequently installed on the container 32.

The packager places a quantity of product in the container 32. This may be a hot-filling process wherein the product has been heated prior to being placed in the container 32. The optional liner or seal 38 may then be placed on the top of the container and heat-sealed to the top of the container 32.

Subsequently, the closed closure 36A is installed on the container 32. Typically, the closed closure 36A is installed with an automatic capping machine employing well-known techniques, the details of which form no part of the present invention.

The installation of the closure 36A on the container 32 completes the creation of the package. If the product placed in the container 32 had not been previously heated, the product can now be heated in the completed package. Such heating of a completed package may be employed in typical, conventional pasteurization processes, the details of which form no part of the present invention.

In any event, the heat from the product in the container, and/or heat that is externally applied to the closed package, can cause heating of the internal atmosphere under the closure inside of the closure lid collar 78A'. For example, the internal atmosphere both below and above the valve 60A may increase in temperature from the heating and may expand as the pressure slightly increases as a result of the temperature increase. However, owing to the vent channel 81A', the expanding internal atmosphere can readily vent out past the spout 52A.

Subsequently, in order to accommodate further processing of the package, the package is cooled in a cooling tunnel employing a cool water shower. For example, if the container is made from a thermoplastic material, then such cooling permits a label to be more readily applied to the container because the cooler container wall will less readily buckle or deform from the forces imposed during the labeling process. Further, if the package container is made from a thermoplastic material, the cooler container will be stronger and less likely to buckle than a hot container during subsequent handling and stacking where vertical loads or other loads are applied to the package.

The cooling water sprayed against the package in the cooling tunnel may enter the closure through openings, such as openings in the region of the hinge 72A However, when the vented closure package is subjected to this process, the amount of water introduced into, and remaining inside, the lid 70A on the deck 50A and/or the internal spout region of the package is eliminated, or at least substantially minimized. Thus, when the consumer opens the closure on the package for the first time, the consumer will not notice any significant water either around the exterior of the spout region that had been covered by the lid or within the spout region that had been surrounded by the closure lid collar 78A'.

This is a surprising result. The inventor did not initially think that processing a package with a vent channel would eliminate or minimize water infiltration under the lid 70A and/or into the interior of the lid collar 78A'. To the contrary, the inventor had thought that processing a hot package with a vented closure through a cool water spray would lead to greater water infiltration rather than less.

Without intending to be bound by any theory or explanation, the inventor offers the following explanation for the beneficial results. As the internal atmosphere within the closed spout cools, the pressure within the closure tends to decrease and drop below the external ambient atmosphere. The pressure differential can draw external ambient atmosphere in through the vent channels 81A'. However, the vent channels 81A' provide a flow area that is sufficient to significantly minimize the transient pressure differential between the internal atmosphere within the closed closure and the external ambient atmosphere, and this significantly minimizes or eliminates the amount of water and/or water vapor that might otherwise be sucked into the closed closure under the lid 70A onto the deck 50A and/or past the engaging surfaces of the lid collar 78A' and spout 52A. The pressure inside the lid collar 78A' cannot decrease significantly below the pressure of the external ambient atmosphere owing to the significant flow area provided by the vent channels 81A'. Thus, the pressure differential between the inside of the spout 52A and the outside of the spout 52A is minimized. Hence, there is little, or no significant, pressure differential causing flow of water or water vapor into the lid 70A and past the lid collar 78A' into the spout 52A. The lack of a significant pressure differential minimizes or eliminates entrainment of water or water vapor from outside of the closure lid to the deck 50A, and this also eliminates, or at least significantly minimizes, entrainment of water or water vapor past the closure lid collar 78A' into the spout region.

As a result of employment of the vent channels 81A', the pressure of the internal atmosphere within the lid collar 78A' remains substantially equal to the pressure of the external ambient atmosphere, or at least the pressure of the internal atmosphere is not significantly lower than the external ambient atmosphere so that the pressure of the internal atmosphere within the lid collar 78A' very quickly becomes equal to the pressure of the external ambient atmosphere. Because the internal atmosphere inside the lid collar 78A' is substantially equal, or quickly becomes equal, to the pressure of the external ambient atmosphere, any small amount of water vapor that may have infiltrated past the lid collar 78A' into the spout region can flow out through the vent channels in response to a water vapor gradient established when the external ambient atmosphere humidity becomes less than the internal atmosphere humidity.

In a presently preferred closure design for use with the process of the present invention, three vent channels 81A' are employed. Each vent channel 81A' has a width of about 1.524 mm. The segments of the lid collar seal bead 80A' have a radial thickness of about 0.51 mm. projecting from the cylindrical interior surface of the lid collar 78A' wherein the cylindrical interior surface has a diameter of about 14.43 mm. The depth of each vent channel 81A' relative to the cylindrical interior surface of the lid collar 78A' is about 0.127 mm.

In this specification and in the claims, the term "internal atmosphere" refers to the atmosphere inwardly of the engaging surfaces (e.g., sealing surfaces) of the coacting spout and lid occlusion member (e.g., the spout 52A and the lid collar 78A' illustrated in FIG. 6). In an alternate embodiment (not illustrated), wherein the lid collar 78A' is replaced with the previously described interior lid plug to engage the inside surface of the spout 52A, then the "internal atmosphere" is inwardly of the coacting lid plug circumferential engaging surface and the spout interior engaging surface.

It will be readily apparent from the foregoing detailed description of the invention and from the illustrations thereof that numerous variations and modifications may be effected without departing from the true spirit and scope of the novel concepts or principles of this invention.

What is claimed is:

1. A process for minimizing moisture accumulation in a product package, said process comprising the steps of:

(A) placing a quantity of said product in a container that has an opening;

(B) installing a dispensing closure on said container over said opening to form a package wherein said closure includes (1) a body having a spout that (a) defines a dispensing orifice, and (b) has an exterior surface and an interior surface, (2) a closed lid having an occlusion member closing said spout, (3) a first engaging surface on the exterior or interior of said spout, (4) a second engaging surface on said occlusion member for engaging said spout first engaging surface, and (5) a vent channel defined through one of said first and second engaging surfaces;

(C) heating said product;

(D) allowing some of the internal atmosphere within the closed spout to expand from the heat and to vent through said vent channel to the external ambient atmosphere;

(E) cooling said package with a cooling water shower; and (F) permitting said external ambient atmosphere to enter said closed spout through said vent channel to the internal atmosphere within the closed spout as said package cools and the pressure of the internal atmosphere within said closed spout starts to decrease whereby the entering external ambient atmosphere minimizes the transient pressure differential between the internal atmosphere within the closed spout and the external ambient atmosphere so that the amount of water and/or water vapor entering past the closed lid and entering the closed spout past said first and second engaging surfaces and/or through said vent channel is minimized and whereby, after equalization between the pressure of the internal atmosphere and the pressure of the external ambient atmosphere, water vapor in the internal atmosphere within the closed spout can flow out of the closed spout through said vent channel in response to a water vapor gradient established when the external ambient atmosphere humidity is less than the internal atmosphere humidity.

2. The process in accordance with claim 1 in which said step (C) is performed before step (B).

3. The process in accordance with claim 1 in which said step (C) is performed after step (B).

4. The process in accordance with claim 1 in which said step (E) includes moving said package in a cooling tunnel wherein said package is subjected to a cool water spray.

5. The process in accordance with claim 1 in which step (C) is performed before, during and/or after step (A).

* * * * *